US009572444B2

(12) United States Patent
Ecseri et al.

(10) Patent No.: US 9,572,444 B2
(45) **Date of Patent: *Feb. 21, 2017**

(54) DRINKING STRAW

(71) Applicant: Silman Invest & Trade Ltd., Victoria, Mahe (SC)

(72) Inventors: Ferenc Ecseri, Cegled (HU); Monika Ecseri, Budapest (HU)

(73) Assignee: Silman Invest & Trade Ltd., Victoria, Mahe (SC)

( * ) Notice: Subject to any disclaimer, the term of this patent is extended or adjusted under 35 U.S.C. 154(b) by 219 days.

This patent is subject to a terminal disclaimer.

(21) Appl. No.: 13/944,516

(22) Filed: Jul. 17, 2013

(65) Prior Publication Data

US 2013/0302472 A1 Nov. 14, 2013

Related U.S. Application Data

(63) Continuation-in-part of application No. PCT/HU2012/000081, filed on Aug. 30, 2012.

(30) Foreign Application Priority Data

Sep. 1, 2011 (HU) ..... 11 00477
Aug. 29, 2012 (HU) ..... 12 00495
Nov. 16, 2012 (HU) ..... 12 00663

(51) Int. Cl.
*A47G 21/18* (2006.01)

(52) U.S. Cl.
CPC ..... *A47G 21/183* (2013.01)

(58) Field of Classification Search
CPC .... A47G 21/18; A47G 21/183; A47G 21/001; A23G 3/56; A23G 3/563; A23P 1/005; A23L 1/0005; B65D 77/283; B65D 2517/0049; B65D 77/28
(Continued)

(56) References Cited

U.S. PATENT DOCUMENTS 2,436,505 A * 2/1948 Du Rall ..... A61J 7/0038 239/33
4,921,713 A * 5/1990 Fowler ..... 426/85
(Continued)

FOREIGN PATENT DOCUMENTS

CN 2154641 Y * 2/1994
EP 111188 A1 * 6/1984
(Continued)

OTHER PUBLICATIONS

"Got Milk? cocoa—Magic Milk Straws Review," Oct. 10, 2010 http://www.gotchocolate.com/2010/10/review-got-milk-cocoa-magic-milk-straws/.*
(Continued)

*Primary Examiner* — Viren Thakur
(74) *Attorney, Agent, or Firm* — Olson & Cepuritis, Ltd.

(57) ABSTRACT

The invention relates to a drinking straw comprising:
a thermoplastic wall having an elongate container portion;
liquid permeable closures closing off the container portion;
at least one effervescent tablet disposed within the container portion such that a clearance is left between the inner side of the wall and the at least one tablet;
a hygroscopic filler disposed at both sides of the at least one tablet within the container portion.

10 Claims, 4 Drawing Sheets

(58) Field of Classification Search
USPC ..... 426/85; 239/33
See application file for complete search history.

(56) References Cited

U.S. PATENT DOCUMENTS

| | | | | |
|---|---|---|---|---|
| 6,109,538 | A * | 8/2000 | Villani et al. | 239/33 |
| 2005/0142252 | A1* | 6/2005 | Brown et al. | 426/85 |
| 2008/0197141 | A1* | 8/2008 | Felfoldi | 220/705 |
| 2009/0041904 | A1* | 2/2009 | Baron | 426/85 |

FOREIGN PATENT DOCUMENTS

| | | | | |
|---|---|---|---|---|
| HU | 3175 | U | * | 10/2006 |
| RU | 2136561 | C1 | * | 9/1999 |
| WO | WO 2008055296 | A1 | * | 5/2008 |
| WO | WO 2008062241 | A1 | * | 5/2008 |
| WO | WO 2010050647 | A1 | * | 5/2010 |

OTHER PUBLICATIONS

Definition of "tablet" The Collins English Dictionary. Retrieved Mar. 11, 2012.*
Definition of "granule." The American Heritage Dictionary of the English Language. 2011.*
Machine translation of EP 0111188—(retrieved May 31, 2016).*

* cited by examiner

DRINKING STRAW

CROSS-REFERENCE TO RELATED APPLICATIONS

This application is a continuation-in-part of International Application No. PCT/HU2012/000081, filed on Aug. 30, 2012, and claims priority of Hungarian Patent Application No. P 12 00663, filed on Nov. 16, 2012, Hungarian Patent Application No. P 12 00495 filed on Aug. 29, 2012, and Hungarian Patent Application No. P 11 00477, filed on Sep. 1, 2011, each of which is incorporated herein by reference in its entirety.

FIELD OF THE INVENTION

The invention relates to a drinking straw for progressively adding active ingredients to liquid passing through the drinking straw.

BACKGROUND OF THE INVENTION

Drinking straws are known for flavouring or changing the flavour of a liquid passing through the drinking straw. Such drinking straws can impart different flavours (e.g. cocoa, fruit, etc.) to a liquid for example milk.

There are solutions in which the flavouring agent is applied on a portion of the drinking straw and dissolves when this portion is immersed in the liquid. U.S. Pat. No. 3,615,595 describes such flavouring drinking straw. In another embodiment according to U.S. Pat. No. 3,615,595 the flavouring agent is applied on the inner wall of the drinking straw. A disadvantage of this solution is that dissolution of the flavouring agent thereby the flavouring effect is unsatisfactory.

U.S. Pat. No. 5,094,861 discloses an improved embodiment of the flavoured drinking straw of U.S. Pat. No. 3,615,595. Here, carriers of flavouring agent are inserted in the drinking straw. Embodying of this drinking straw is complicated, placing the flavouring agent in the straw requires an elaborate method while the flavouring effect is still unsatisfactory.

The solution proposed in U.S. Pat. No. 6,109,538 differs from the earlier known solutions in that a large sized flavouring object is disposed in the lumen of the drinking straw.

A common disadvantage of the aforementioned embodiments is that proportionally to the dissolution of the flavouring agent placed in the interior of the drinking straw the flavouring effect also decreases and the force required to sip the drinking straw varies significantly especially in the latter solution.

Patent application WO 9851259 is directed to an oral active agent delivery device comprising improved flow controllers.

Here, a hollow tubular member containing the active agent formulation and having a fluid passing controller is placed at one end into a fluid and at a second end into a patient's mouth. The active agent is delivered when the patient sips on the end of the tube. This improved solution prevents leakage of the active agent formulation. This document teaches a number of complicated filtering elements that can be inserted in the drinking straw. On the one hand dosing of the active agent according to this solution is complicated on the other hand it is expensive and flavouring of the active agent may be realized at most by flavouring the fluid in which the device is placed.

Effervescent tablets are also generally used in the food and medical industry. Effervescent tablets are tablets that are designed to break down rapidly when they are placed into water or another liquid, releasing carbon dioxide in the process. The rapid breakdown causes the tablet to dissolve into a frothy or fizzy solution, which property is particularly appealing to younger consumers. Such tablets are also extensively used for the administration of minerals (e.g. calcium, magnesium), vitamins and various drugs (medication).

Effervescent tablets are made by compressing the component ingredients into a dense mass, which is packaged in an airtight container or other airtight packaging since otherwise the tablet would react with humidity (water vapor) contained in the air.

The aim of the present invention is to provide a drinking straw which contains one or more effervescent tablets in order to produce a fizzy drink when a neutral liquid, such as water, is drawn through the straw. The inventors have realized that simply disposing effervescent tablets in any of the prior art filled drinking straws does not solve this problem as the effervescent tablet is not stable once the packaging of the straw is opened, however, consumers often wish to consume a beverage over a longer period of time, or use the same straw more than once. Furthermore, if the effervescent tablet sinks to the bottom of the straw immersed in the liquid then it will dissolve too fast. However, if the tablet floats in the liquid, it will rise to the top of the straw and cause inconvenient foaming in the vicinity of the user's mouth.

SUMMARY OF THE INVENTION

The above problems are overcome by a drinking straw comprising:

- a thermoplastic wall having an elongate container portion;
- liquid permeable closures closing off the container portion;
- at least one effervescent tablet disposed within the container portion such that a clearance is left between the inner side of the wall and the at least one tablet;
- a hygroscopic filler disposed at both sides of the at least one tablet within the container portion.

Further advantageous embodiments of the invention are defined in the attached dependent claims.

Further details of the invention will be apparent from the accompanying figures and exemplary embodiments.

DETAILED DESCRIPTION OF PREFERRED EMBODIMENTS

Figure 1A:
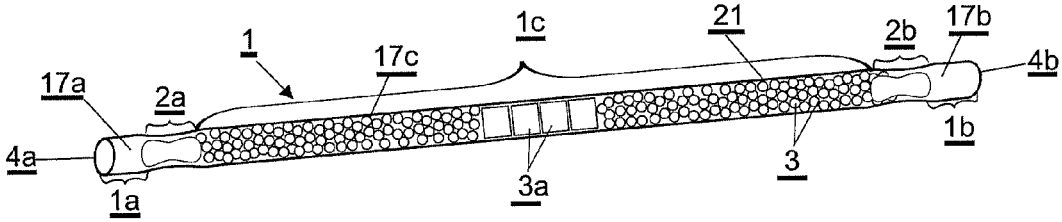
FIG. 1*a* is a schematic perspective view of a first preferred embodiment of a drinking straw according to the invention.

FIG. 1*a* schematically illustrates a first preferred embodiment of a drinking straw 1 in accordance with the present invention. According to the illustrated embodiment the straw 1 comprises a first tubular end portion 1*a*, a second tubular end portion 1*b*, an elongate tubular container portion 1*c*, a first branched portion 2*a* connecting the first tubular end portion 1*a* with the container portion 1*c* and a second branched portion 2*b* connecting the second tubular end portion 1*b* with the container portion 1*c*. The straw 1 and its portions 1*a*, 1*b*, 1*c*, 2*a*, 2*b* are defined by a plastic wall 21 having a first end 4*a* and a second end 4*b*. The first tubular end portion 1*a* is adjacent the first end 4*a* of the straw 1 while the second tubular end portion 1*b* is adjacent the second end 4*b* of the straw 1.

The first and second branched portions 2*a*, 2*b* each define at least two but preferably three to five parallel passages 17 (see FIG. 5) that are in fluid communication with a single passage 17*a*, 17*b* of the first and second tubular end portion 1*a*, 1*b* respectively. The parallel passages 17 of the first and second branched portions 2*a*, 2*b* are defined by neighbouring recesses 22 formed in the wall 21 of the straw 1 and an inner seam 23 connecting inner points of the neighbouring recesses 22.

In the present embodiment the elongate container portion 1*c* also comprises a single passage 17*c* providing fluid communication between the parallel passages 17 of the first and second branched portions 2*a*, 2*b*. At least one effervescent tablet 3*a* disposed within the passage 17*c* of the container portion 1*c* such that a clearance 24 is left between the inner side of the wall 21 and the tablet 3*a*. The clearance is preferably 0.1 to 1 mm wide (but may be greater too) in case of cylindrical tablets 3*a* (i.e. this is the difference between the radius of the tablet 3*a* and of the inner cross section of the passage 17*c*. In case of tablets 3*a* having a non-circular cross section (e.g. star shaped tablets or other decorative shapes) the clearance is determined by the deviation of the cross section from a circle.

According to the present embodiment four effervescent tablets 3*a* are disposed approximately at the middle of the container portion 1*c* and are kept in place by a hygroscopic filler 3 also disposed within the passage 17*c* of the container portion 1*c* at both sides of the four tablets 3*a*.

Figure 1B:
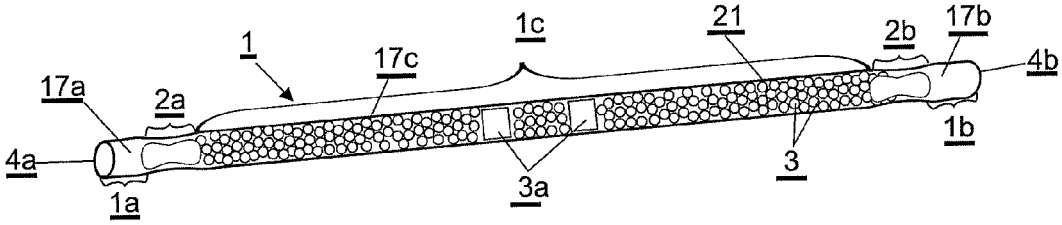
FIG. 1 *b* is a schematic perspective view of a second preferred embodiment of a drinking straw according to the invention.

Some or all of the effervescent tablets 3*a* may comprise at least one type of active ingredient chosen from the group consisting of flavoring agents, minerals, vitamins, drugs, food additives, proteins. It is also possible to dispose more or less tablets 3*a*, furthermore, it is also possible to dispose filler 3 between the tablets 3*a* as well as illustrated in FIG. 1*b*.

The hygroscopic filler 3 is an edible food industry product, preferably granules containing sugar. The term "granule" is understood to include all kinds of small grains, particles, granulate materials, pellets, nonpareils, dragees etc. used in the food industry. The granules may have a homogeneous structure or they may comprise one more coatings or layers.

The hygroscopic filler 3 generally comprises spherical (i.e. spherical or close to spherical) particles having an average diameter between 15 to 25% of the inner diameter of the tubular container portion 1*c* in order to provide a sufficiently large surface area for absorbing humidity, but at the same time being sufficiently large to be retained by the branched portions 2*a*, 2*ba* and not to clog the parallel passages 17 thereof during use. In order to render the drinking straw 1 more attractive the hygroscopic filler 3 disposed on the opposite sides of the tablets 3*a*, and optionally between the tablets 3*a*, may differ in color, size or shape from each other.

The filler 3 (preferably in the form of granules) may also contain solvable active ingredients that progressively dissolve into a liquid drawn through the straw 1. Such active ingredients may be flavouring substances, edible colorants, vitamins, minerals, food additives and the like. The inventors have found that dissolution of the active ingredients is generally enhanced by the effervescence produced by the tablets 3*a*.

According to a preferred embodiment the filler 3 is in the form of granules which comprise a core and one or more coatings provided thereon comprising one or more kinds of active ingredients. For example the core may be a sugar seed and a coating comprising one or more active ingredients may be formed thereon by any known technology.

The branched portions 2*a*, 2*b* serve as closures that are permeable to liquid but otherwise close off the container portion 1*c* in order to retain the hygroscopic filler 3 and effervescent tablets 3*a* therein. The dimensions (in particular cross section) of the filler 3 and the cross section of the parallel passages 17 of the branched portions 2*a*, 2*b* are chosen such as to prevent the filler 3 from passing through the parallel passages 17 of the first and second branched portions 2*a*, 2*b* but allow liquid to be drawn through the straw 1 thereby retaining the filler 3 in the container portion 1*c* when the drinking straw 1 is being used. According to a preferred embodiment the filler 3 comprises spherical or near spherical granules in which case the skilled person will easily determine the minimal diameter of the granules that can be retained by the parallel passages 17 having a given size and shape. Otherwise the average cross section of the filler 3 can be taken into account. It is also possible to dimension the parallel passages 17 so as to retain a filler 3 of a given size and shape. Increasing the number of the recesses 22 and thereby the number of the passages 17 formed there between results in more narrow cross section of the passages 17. Furthermore, using thicker spacers 13 increases the cross section of the passages 17 as will be explained later on.

The hygroscopic filler 3 fulfils two main purposes. Firstly, the filler 3 attracts and holds water molecules (thus humidity present in the air) by absorption or adsorption whereby the effervescent tablets 3*a* are protected even after the packaging of the drinking straw 1 has been opened or even if the packaging is not fully airtight. Secondly the filler 3*a* serves as spacers in order to keep the tablets 3 at a distance from both ends 17*a*, 17*b*. This has for result that the foaming caused by the tablets 3 does not occur directly in the vicinity of the user's mouth who uses one of the tubular end portions 2*a*, 2*b* as the mouthpiece, as such foaming might be inconvenient. Another benefit of the spacing provided by the filler 3 is that the tablets 3*a* are not constantly immersed in the liquid when the user places the other tubular end portion 2*b*, 2*a* into the beverage, whereby the beverage can be consumed over a longer period of time yet effervescence occurs all the time the liquid is drawn through the straw 1.

Figure 2:
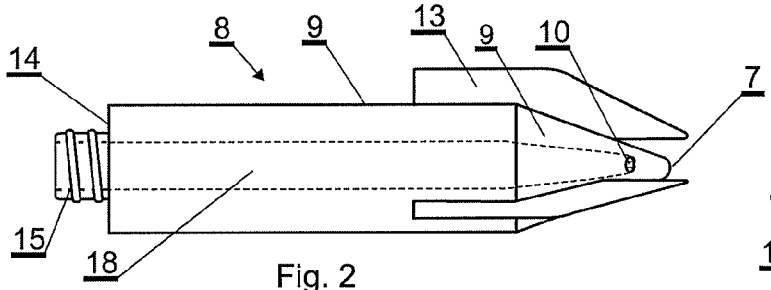
FIG. 2 is a side view of a preferred embodiment of a nozzle according to the invention.
Figure 3:
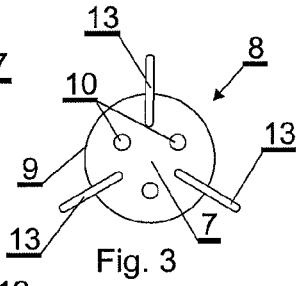
FIG. 3 is a front view of the nozzle according to FIG. 2.
Figure 4:
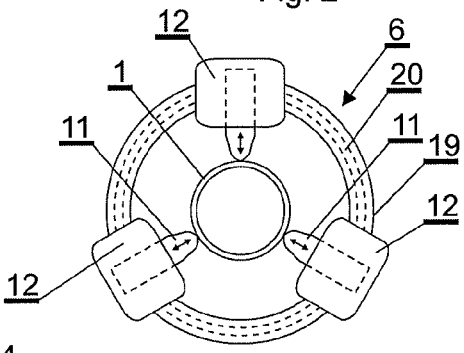
FIG. 4 is a front view of a pressing tool according to the invention, which is illustrated in the open position surrounding the straw prior to deformation.
Figure 5:
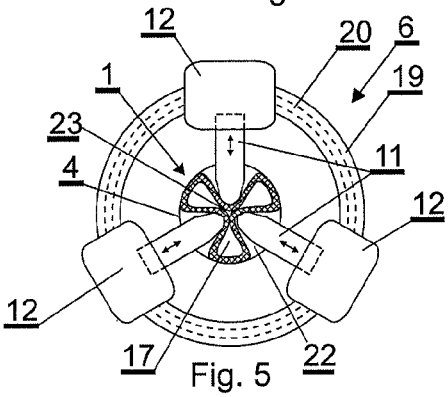
FIG. 5 is a front view of the pressing tool according to FIG. 4 illustrated in the closed position surrounding the straw and showing the cross section of a branched portion created by deformation of the straw.

The drinking straw 1 according to the invention can be formed by a device 5 (best shown in FIG. 6) comprising a nozzle 8 (FIGS. 2 and 3) and a pressing tool 6 (FIGS. 4 and 5). The nozzle 8 comprises a head 9 that is provided with openings 10 near the nozzle end 7 preferably along a circular perimeter and evenly spaced apart from each other. The openings may have a diameter of about 0.3 to 1 mm. Spacers 13 are also provided on the nozzle head 9 which serve to ensure the formation of passages 17 in order to allow liquid communication through the branched portions 2*a*, 2*b*. The shape and thickness of the spacers 13 determine the cross section of the passages 17 as will be apparent to the skilled person. Accordingly, at least two but preferably three to five spacers 13 are provided to form a corresponding number of parallel passages 17. Furthermore, preferably the number of the openings 10 also corresponds to the number of the parallel passages 17 to be formed, and the spacers 13 are preferably evenly spaced between the openings 10 as illustrated in FIGS. 2 and 3. According to the present embodiment the nozzle 8 comprises a nozzle inlet 14 which is provided with a connector portion 15 that is connected with the openings 10 via an internal channel 18. The connector portion 15 allows for connecting the nozzle 8 to a hot air supply providing preferably hot air of about 150 to 250° C. and of about 300 to 700 kPa (3 to 7 bar) pressure, which is conducted to the openings 10 through the channel 18. Other hot fluids than air may be used as well to form the branched portion 2 as will be apparent to the skilled person.

According to the present embodiment the pressing tool 6 comprises chucks 12 and pressing rods 11 inserted therein (see FIGS. 4 and 5). The number of the chucks 12 and pressing rods 11 correspond to the number of the parallel passages 17 to be formed. The pressing rods 11 are displaceable in the direction of the arrows indicated in FIGS. 4 and 5. Displacement of the pressing rods 11 might be achieved by means of hydraulic or pneumatic action or by any other known means. For example the chucks 12 might be supported by a connector 19 having an inner duct 20 for conducting the actuating medium of the pressing rods 11 to the chucks 12. For example the pressing rods 11 may be held in an initial position by means of springs (not shown).

The method of producing the drinking straw 1 according to the invention and in particular of forming the branched portions 2*a*, 2*b* of the drinking straw 1 will be explained with reference to the device 5.

Figure 7:
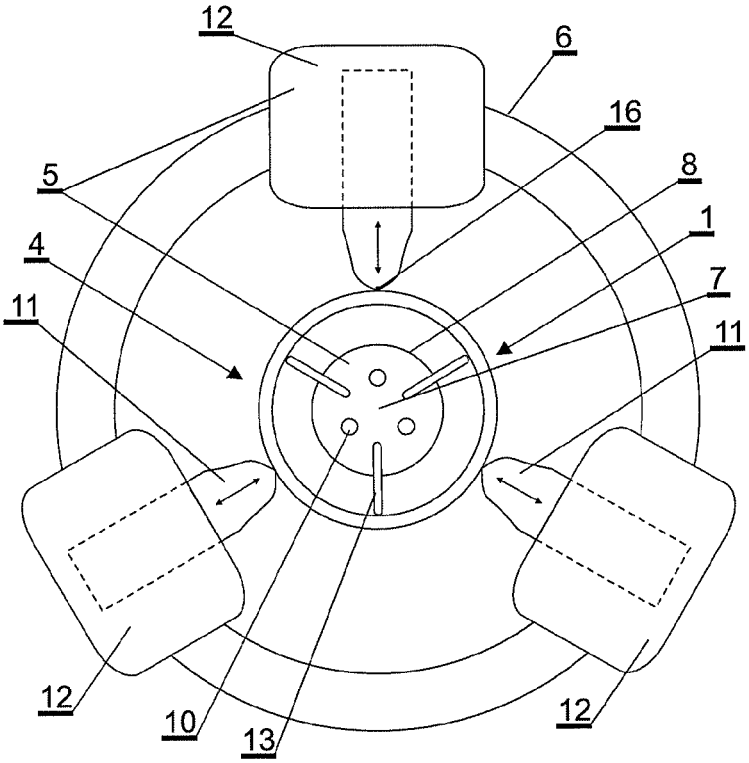
FIG. 7 is a front view of the device showing the nozzle inserted within the straw and the pressing tool arranged around the not yet filled straw.

When using the device 5 the nozzle 8 is inserted into the drinking straw 1 such that the spacers 13 reach at least partly into the portion of the drinking straw 1 where the branched portion 2*a*, 2*b* is to be formed. The wall 21 of the drinking straw 1, where the branched portion 2*a*, 2*b* is to be formed, is fitted between the pressing rods 11 of the pressing tool 6 such that the pressing ends 16 of the pressing rods 11 are each facing a longitudinal axis defined by one opening 10 of the nozzle 8 between two neighbouring spacers 13 as illustrated in FIG. 7. The pressing ends 16 of the pressing rods 11 are somewhat shifted with respect to the openings 10 and the nozzle end 7 in order to allow the pressed regions of the wall 21 of the straw 1 to contact each other or a filling element 3*a* placed within the straw 1 when the pressing rods 11 are pushed inside.

Figure 6:
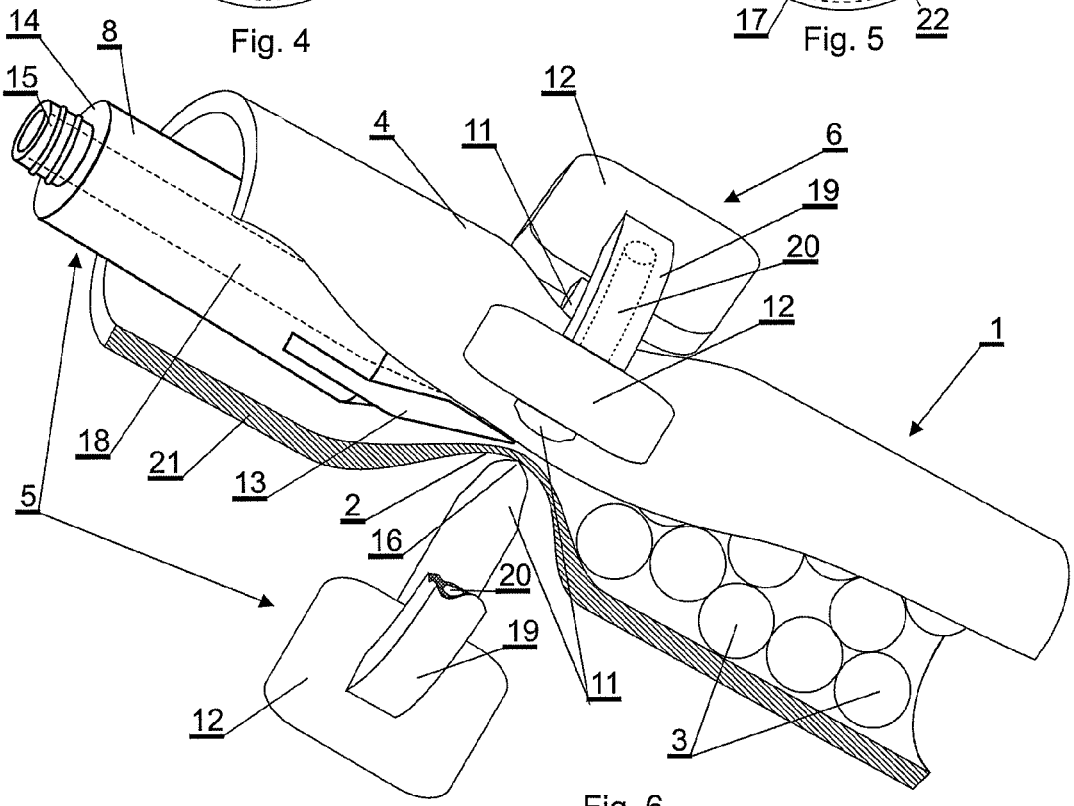
FIG. 6 is a partial cutaway perspective view of a device comprising the nozzle according to FIG. 2 and the pressing tool according to FIG. 4, illustrating the deformation of a second portion of the straw once a first deformed portion has been created in accordance with FIG. 5 and the straw has been filled with a filler.
Figure 8:
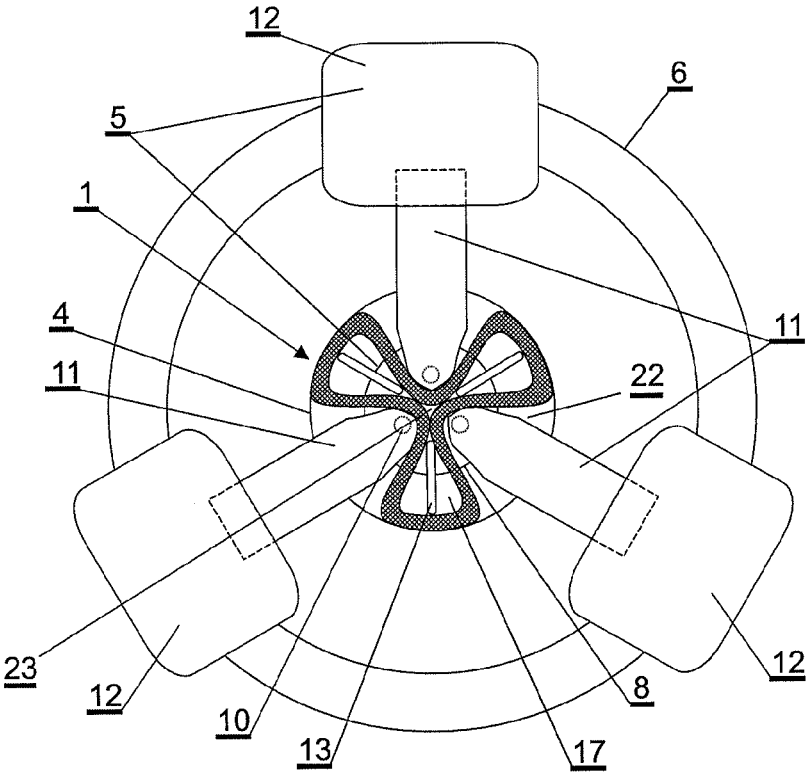
FIG. 8 is a front view of the device showing the nozzle inserted within the straw and the pressing tool arranged around the not yet filled but already pressed straw.
Figure 10:
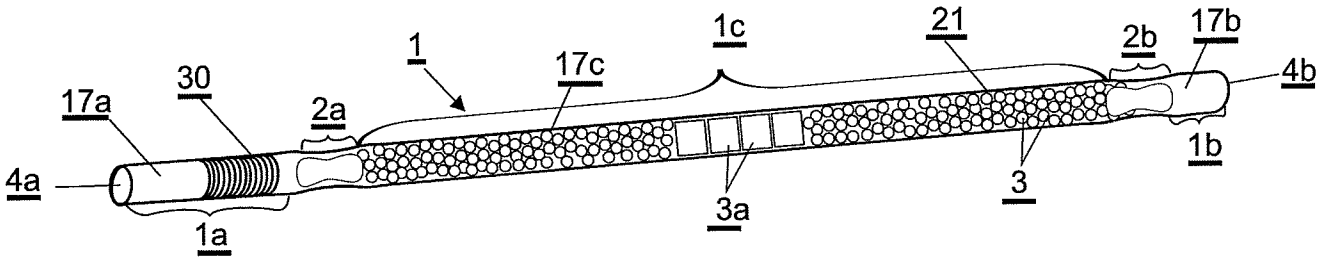
FIG. 10 is a schematic perspective view of a fourth embodiment of a drinking straw according to the invention comprising an angle-adjustable bellows segment.

Formation of the branched portions 2*a*, 2*b* is illustrated in FIGS. 6 to 8.

Firstly, prior to filling the straw 1 with the filler 3 and the one or more tablets 3*a*, the first branched portion 2*a* is formed spaced apart from the first end 4*a* of the straw 1 via the device 5. The straw 1 is inserted into the pressing tool 6 such that the middle part of the branched portion 2*a*, 2*b* to be formed lies between the pressing rods 11 of the pressing tool 6. Following this, the nozzle 8 (FIG. 2) is inserted into the straw 4 such that the nozzle end 7 does not reach the working section of the pressing rods 11 in order to allow the pressing rods 11 to push the wall 21 of the straw inside. The wall 21 of the straw 1 is preferably made from a thermoplastic material, preferably from polypropylene that can be easily deformed when applying heat thereto. The first branched portion 2*a* is formed by applying heat to the inside of the wall 21 by directing high pressure hot air of about 150-250° C., preferably of about 250° C. and of about 500 kPa pressure at the wall 21 through the openings 10 of the nozzle 8 for a very short period of time preferably about 0.2 to 0.6 sec, most preferably about 0.5 sec. The temperature and pressure of the hot air is chosen with regard to the thickness and material properties of the wall 21. If the wall 21 is thick then higher temperatures and greater pressure may be used. Generally the hot air is applied for no longer than 1 sec and the pressure is not increased over 700 kPa.

By supplying hot air to the channel 18 of the nozzle 8 at high pressure and directing the hot air at the inner side of the wall 21 of the straw 1 through the openings 10, the regions of the wall 21 facing the pressing rods 11 is heated and plasticized (or melted) for about 0.2 to 0.6 sec, most preferably about 0.5 sec. After this, the heated regions of the wall 21 are pressed against each other via the pressing rods 11 for a time period of about 0.5 to 1.5 sec, preferably for about 1 sec. For example, the pressing rods 11 may be actuated by means of hydraulic or pneumatic force and may be kept in the initial position by spring force. Heating the inner side of the wall 21 of the straw 1 ensures that the wall 21 can be deformed without causing cracks or other damages. By pressing the pressing rods 11 inside recesses 22 are formed in the wall 21 and where the inner points of the recesses 22 meet the plasticized (melted) material bonds thereby creating an inner seam 23. In practice the method can be regarded as spot welding.

The spacers 13 have for function to support the wall 21 of the straw 1 between the pressed locations whereby parallel passages 17 are created between the recesses 22. The shape and size of the parallel passages 17 can be influenced by the shape and dimension of the spacers 13. The spacers 13 preferably reach beyond the nozzle end 7. In order not to require an excessive thinning of the wall 21 at the branched portions 2*a*, 2*b*, the spacers 13 are preferably tapered whereby the regions between the pressed locations are also drawn inside and the cross sectional diameter of the branched portions 2*a*, 2*b* becomes smaller than the diameter of the tubular end portions 1*a*, 1*b* and the container portion 1*c*.

Once the first branched portion 2*a* has been created the approximately half of the container portion 1*c* of the straw 1 is filled with the hygroscopic filler 3 through the second open end 4*b* of the straw 1. The branched portion 2*a* stops the filler 3, which is preferably in the form of granules, from falling out through the first open end 4*a*. Following this one or more effervescent tablets 3*a* a disposed within the container portion 1*c*, optionally alternate with more fillers 3 in order to separate the tablets 3*a* from each other as well. After having disposed the tablets 3 the rest of the container portion is filled with further hygroscopic filler 3. Once the container portion 1*c* has been filled the second branched portion 2*b* is created in a similar way as the first branched portion 2*a* (see FIG. 6).

The branched portions 2*a*, 2*b* are preferably spaced apart from the first and second ends 4*a*, 4*b* of the straw 1 respectively and their locations are chosen so as to leave sufficiently long tubular end portions 1*a*, 1*b* that can serve as a mouthpiece when the user uses the drinking straw 1. The first and second tubular end portions 1*a*, 1*b* may be symmetric and the user may use either one as the mouthpiece. According to another preferred embodiment one of the tubular end portions 1*a*, 1*b* comprises an angle-adjustable bellows segment 30 which is well known in the art and is conventionally used in so-called bendable straws. In the latter case this tubular end portion 1*a*, 1*b* serves as the mouthpiece.

Figure 9:
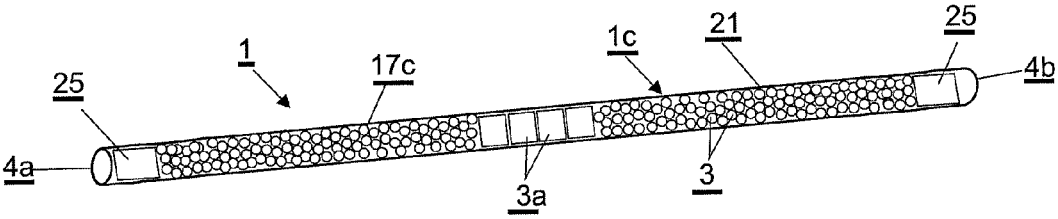
FIG. 9 is a schematic perspective view of a third preferred embodiment of a drinking straw according to the invention.

According to a second preferred embodiment illustrated in FIG. 9 the liquid permeable closures retaining the hygroscopic filler 3 and the effervescent tablets 3*a* are in the form of filters 25 located at the two ends of the container portion 1*c*. In this case the separate tubular end portions 1*a*, 1*b* can be dispensed with and the container portion's 1*c* ends correspond to the ends 4*a*, 4*b* of the straw 1. The filters 25 can be any type of filters generally used in the art, e.g. filter caps disclosed in U.S. Pat. No. 8,334,003 B1 or integral end filters disclosed in US 2012/0228400 A1.

When using the drinking straw 1 the user inserts one end 4*b* into a preferably neutral beverage such as water, takes the opposite end 4*a* into his or her mouth, and applies sucking force so as to draw the liquid (beverage) through the straw 1. The liquid enters the container portion 1*c* through the liquid permeable closure (e.g. through the parallel passages 17 of the second branched portion 2*b* or the apertures of the end filter 25), which retains the filler 3 and the effervescent tablets 3*a*. The liquid then passes through the elongate container portion 1*c* containing the filler 3 and the tablets 3*a*. As the liquid comes into contact with the tablets 3*a* effervescence occurs and a fizzy/foamy beverage is produced which may contain active ingredients as well (such as flavouring agents, colorants, food additives, vitamins, drugs, etc.) depending on the composition of the filler 3 and tablets 3*a*. Furthermore, the solid material of the filler 3 (preferably sugar) may also dissolve. The fizzy/foamy liquid carrying the dissolved active agents and solid materials passes between the particles of the filler 3 separating the tablets 3*a* from the closure (branched portion 2*a* or filter 25), whereby excessive foaming is gradually reduced. The liquid then passes through the liquid permeable closure (e.g. the parallel passages 17 of the first branched portion 2*a* or the apertures of the filter 25) while the filler 3 is prevented from exiting the container portion 1*c*. The user thus draws fizzy/moderately foamy and/or flavoured or otherwise modified beverage from the upper end 4*a* of the drinking straw 1.

Various modifications to the above disclosed embodiments will be apparent to a person skilled in the art without departing from the scope of protection determined by the attached claims.

The invention claimed is:

1. Drinking straw comprising:

a thermoplastic wall having an elongate container portion;

a first liquid permeable closure closing off a first end of the container portion;

a second liquid permeable closure closing off a second end of the container portion;

at least one effervescent tablet disposed within the container portion such that a clearance is left between the wall and the at least one tablet;

a first plurality of hygroscopic filler granules disposed within the container portion between the at least one effervescent tablet and the first liquid permeable closure, and spacing the at least one effervescent tablet from the first end of the container portion and in an amount protecting the at least one effervescent tablet from humidity; and a second plurality of hygroscopic filler granules disposed within the container portion between the at least one tablet and the second liquid permeable closure, spacing the at least one tablet from the second end of the container portion and in an amount protecting the at least one effervescent tablet from humidity, wherein the closures are branched portions each having at least three parallel passages spaced around a longitudinal axis of the drinking straw, which parallel passages are defined by neighbouring recesses formed in the wall and a common inner seam connecting the neighbouring recesses along the longitudinal axis of the drinking straw; and the first plurality and the second plurality of hygroscopic filler granules and the parallel passages being sized to prevent said first plurality and said second plurality of hygroscopic filler granules from passing through the parallel passages of the first and second branched portions.

2. The drinking straw according to claim 1, wherein the wall has two tubular end portions adjacent the branched portions, and at least one tubular end portion has a mouthpiece.

3. The drinking straw according to claim 2, wherein the tubular end portion having a mouthpiece further comprises an angle-adjustable bellows segment.

4. The drinking straw according to claim 1, wherein more than one effervescent tablet is disposed within the container portion and wherein hygroscopic filler granules are disposed between the tablets.

5. The drinking straw according to claim 1, wherein the closures are filters disposed at the two ends of the container portion.

6. The drinking straw according to claim 1, wherein said first and said second plurality of hygroscopic filler granules are an edible food industry product.

7. The drinking straw according to claim 1, wherein said first plurality and said second plurality of hygroscopic filler granules are sugar granules.

8. The drinking straw according to claim 1, wherein said first and said second plurality of hygroscopic filler granules are generally spherical having an average diameter between 15 to 25% of the inner diameter of the tubular container portion.

9. The drinking straw according to claim 1, wherein the at least one effervescent tablet comprises at least one type of active ingredient chosen from the group consisting of flavoring agents, minerals, vitamins, drugs, food additives, proteins.

10. The drinking straw according to claim 1, wherein the at least one effervescent tablet is situated at a midpoint of the container portion and kept in place by said first and said second plurality of hygroscopic filler granules.

* * * * *